US006189800B1

(12) United States Patent
Fujimoto et al.

(10) Patent No.: US 6,189,800 B1
(45) **Date of Patent: *Feb. 20, 2001**

(54) EXPANSION VALVE

(75) Inventors: Mitsuya Fujimoto; Kazuhiko Watanabe; Masamichi Yano, all of Tokyo (JP)

(73) Assignee: Fujikoki Corporation (JP)

( * ) Notice: Under 35 U.S.C. 154(b), the term of this patent shall be extended for 0 days.

This patent is subject to a terminal disclaimer.

(21) Appl. No.: 09/368,933

(22) Filed: Aug. 5, 1999

Related U.S. Application Data

(62) Division of application No. 08/915,682, filed on Aug. 21, 1997, now Pat. No. 5,957,376.

(30) Foreign Application Priority Data

Oct. 11, 1996 (JP) ..... 8-27009
Jan. 10, 1997 (JP) ..... 9-002803

(51) Int. Cl.[7] ..... F25B 41/04
(52) U.S. Cl. ..... 236/92 B; 62/225
(58) Field of Search ..... 236/92 B; 62/225

(56) References Cited

U.S. PATENT DOCUMENTS

| | | | | |
|---|---|---|---|---|
| 1,512,243 | | 10/1924 | Shrode . | |
| 1,987,948 | | 1/1935 | Smith . | |
| 2,306,768 | | 12/1942 | Wile | 137/157 |
| 2,598,187 | | 5/1952 | Meyer | 251/360 |
| 2,631,612 | | 3/1953 | Buescher | 251/360 |
| 3,537,645 | * | 11/1970 | Treder | 236/92 B |
| 3,667,247 | * | 6/1972 | Proctor | 62/225 |
| 3,810,366 | | 5/1974 | Orth | 62/217 |
| 4,416,416 | | 11/1983 | Maltby | 236/86 |
| 4,468,054 | * | 8/1984 | Orth . | |
| 4,542,879 | | 9/1985 | Stein | 251/360 |
| 4,815,698 | | 3/1989 | Palmer | 251/85 |
| 4,819,443 | | 4/1989 | Watanabe et al. . | |
| 4,834,337 | | 5/1989 | Chorkey et al. | 251/360 |
| 4,979,372 | | 12/1990 | Tanka | 62/225 |
| 4,984,735 | | 1/1991 | Glennon et al. | 62/225 |
| 5,044,170 | | 9/1991 | Tanaka . | |
| 5,060,485 | | 10/1991 | Watanabe et al. . | |
| 5,127,237 | | 7/1992 | Sendo et al. . | |
| 5,165,251 | | 11/1992 | Tsukamoto et al. | 62/244 |
| 5,169,178 | | 12/1992 | Hunzinger | 62/299 |
| 5,228,619 | | 7/1993 | Yano et al. | 236/92 |
| 5,303,864 | * | 4/1994 | Hirota | 62/225 |

(List continued on next page.)

FOREIGN PATENT DOCUMENTS

| | | | |
|---|---|---|---|
| 0537776A1 | * | 4/1993 | (EP) . |
| 0537776B1 | * | 4/1993 | (EP) . |
| 0659600A1 | * | 6/1995 | (EP) . |
| 0691517A1 | * | 1/1996 | (EP) . |
| 831073 | * | 12/1937 | (FR) . |
| 1050101 | * | 2/1952 | (FR) . |

(List continued on next page.)

*Primary Examiner*—William E. Tapolcai
(74) *Attorney, Agent, or Firm*—Rader, Fishman & Grauer

(57) ABSTRACT

The expansion valve of the present invention comprises of a heat sensing shaft 36*f* equipped to the expansion valve 10 and a diaphragm 36*a* contacting its surface, a large stopper portion 312 for receiving the diaphragm 36*a,* a large radius portion 314 movably inserted to the lower pressure activate chamber 36*c* and contacting the back surface of the stopper portion 312 at one end surface and the center of the other end surface formed at the projection 315, and a rod portion 316 whose one end surface fit to the projection 315 of the large radius portion 314 and the other end surface continuing from the valve means 32*b,* wherein a concave 317 is formed on the outer peripheral of said projection 315. This concave 317 is the fitting means for fitting the resin 101 having low heat transmission rate to the heat sensing shaft in order to prevent the occurrence of hunting phenomenon.

14 Claims, 4 Drawing Sheets

U.S. PATENT DOCUMENTS

| | | | | |
|---|---|---|---|---|
| 5,361,597 | | 11/1994 | Hazime et al. | 62/205 |
| 5,467,611 | | 11/1995 | Cummings et al. | 62/299 |
| 5,555,739 | | 9/1996 | Kurijai et al. | 62/225 |
| 5,957,376 | * | 9/1999 | Fujimoto et al. | 236/92 B |

FOREIGN PATENT DOCUMENTS

| | | | |
|---|---|---|---|
| 696 | * | 2/1898 | (GB) . |
| 5-322381 | * | 12/1993 | (JP) . |
| 9 159324 | * | 12/1995 | (JP) . |

* cited by examiner

EXPANSION VALVE

This application is a Divisional of 08/915,682 filed Aug. 21, 1997 U.S. Pat. No. 5,957,376.

TECHNICAL FIELD OF THE INVENTION

The present invention relates to expansion valves and, more particularly, to expansion valves used for refrigerant utilized in refrigeration cycles of air conditioner, refrigeration device and the like.

BACKGROUND OF THE INVENTION

In the prior art, these kinds of expansion valves were used in refrigeration cycles of air conditioners in automobiles and the like. FIG. 9 shows a prior art expansion valve in cross-section together with an explanatory view of the refrigeration cycle. The expansion valve 10 includes a valve body 30 formed of prismatic-shaped aluminum comprising a refrigerant duct 11 of the refrigeration cycle having a first path 32 and a second path 34, the one path placed above the other with a distance inbetween. The first path 32 is for a liquid-phase refrigerant passing through a refrigerant exit of a condenser 5 through a receiver 6 to a refrigerant entrance of an evaporator 8. The second path 34 is for a liquid-phase refrigerant passing through the refrigerant exit of the evaporator 8 toward a refrigerant entrance of a compressor 4.

An orifice 32*a* for the adiabatic expansion of the liquid refrigerant supplied from the refrigerant exit of the receiver 6 is formed on the first path 32, and the first path 32 is connected to the entrance of the evaporator 8 via the orifice 32*a* and a path 321. The orifice 32*a* has a center line extending along the longitudinal axis of the valve body 30. A valve seat is formed on the entrance of the orifice 32*a,* and a valve means 32*b* supported by a valve member 32*c* and forming a valve structure together with the valve seat is included thereto. The valve means 32*b* and the valve member 32*c* are welded and fixed together. The valve member 32*c* is fixed onto the valve means 32*b* and is also forced by a spring means 32*d,* for example, a compression coil spring.

The first path 32 where the liquid refrigerant from receiver 6 is introduced is a path of the liquid refrigerant, and is equipped with an entrance port 321 and a valve room 35 connected thereto. The valve room 35 is a room with a floor portion formed on the same axis of the center line of the orifice 32*a,* and is sealed by a plug 39.

Further, in order to supply drive force to the valve body 32*b* according to an exit temperature of the evaporator 8, a small hole 37 and a large hole 38 having a greater diameter than the small are hole 37 formed on said center line axis perforating through the second path 34. A screw hole 361 for fixing a power element member 36 working as a heat sensor is formed on the upper end of the valve body 30.

The power element member 36 is comprised of a stainless steel diaphragm 36*a,* an upper cover 36*d,* and a lower cover 36*h,* each defining an upper pressure activate chamber 36*b* and a lower pressure activate chamber 36*c* divided by said diaphragm and forming two sealed chambers above and under the diaphragm 36*a,* and a tube 36*i* for enclosing a predetermined refrigerant working as a diaphragm driver liquid into said upper pressure activate chamber, and is fixed to the valve body 30 by a screw 361. Said lower pressure activate chamber 36*c* is connected to said second path 34 via a pressure hole 36*e* formed to have the same center as the center line axis of the orifice 32*a.* A refrigerant vapor from the evaporator 8 is flown through the second path 34. The second path 34 is a path for gas phase refrigerant, and the pressure of said refrigerant vapor is added to said lower pressure activate chamber 36*c* via the pressure hole 36*e.*

Further, inside the lower pressure activate chamber 36*c* is a heat sensing shaft 36*f* made of aluminum and an activating shaft 37*f* made of stainless steel. The heat sensing shaft 36*f* exposed horizontally inside the second path 34 is movably positioned through the second path 34 inside the large hole 38 and contacts the diaphragm 36*a* so as to transmit the refrigerant exit temperature of the evaporator 8 to the lower pressure activate chamber 36*c,* and to provide a driving force in response to the displacement of the diaphragm 36*a* according to the pressure difference between the upper pressure activate chamber 36*b* and the lower pressure activate chamber 36*c* by moving inside the large hole 38. The activating shaft 37*f* is movably positioned inside the small hole 37 and provides pressure to the valve means 32*b* against the spring force of the spring means 32*d* according to the displacement of the heat sensing shaft 36*f.* The heat sensing shaft 36*f* comprises a stopper portion 312 having a large radius and works as a receiving member of the diaphragm 36*a,* the diaphragm 36*a* positioned to contact its surface, a large radius portion 314 contacting the lower surface of the stopper portion 312 at one end surface and being moveably inserted inside the lower pressure activate chamber 36*c,* and a heat sensing portion 318 contacting the other end surface of said large radius portion 314 at one end surface and having the other end surface connected to the activating shaft 37*f.*

Further, the heat sensing shaft 36*f* is equipped with an annular sealing member, for example, an o-ring 36*g,* for securing the seal of the first path 32 and the second path 34. The heat sensing shaft 36*f* and the activating shaft 37*f* are positioned so as to contact each other, and activating shaft 37*f* also contacts the valve means 32*b.* The heat sensing shaft 36*f* and the activating shaft 37*f* form a valve driving shaft together. Therefore, the valve driving shaft extending from the lower surface of the diaphragm 36*a* to the orifice 32*a* of the first path 32 is positioned having the same center axis in the pressure hole 36*e.*

Further, the heat sensing shaft 36*f* and the activating shaft 37*f* could be formed as one, with the heat sensing shaft 36*f* being extended so as to contact the valve means 32*b.* Still further, a plug body could be used instead of the tube 36*i* for sealing the predetermined refrigerant.

A known diaphragm driving liquid is filled inside the upper pressure activating chamber 36*b* placed above a pressure activate housing 36*d,* and the heat of the refrigerant vapor from the refrigerant exit of the evaporator 8 flowing through the second path 34 via the diaphragm 36*a* is transmitted to the diaphragm driving liquid.

The diaphragm driving liquid inside the upper pressure activate chamber 36*b* adds pressure to the upper surface of the diaphragm 36*a* by turning into gas in correspondence to said heat transmitted thereto. The diaphragm 36*a* is displaced in the upper and lower direction according to the difference between the pressure of the diaphragm driving gas added to the upper surface thereto and the pressure added to the lower surface thereto.

The displacement of the center portion of the diaphragm 36*a* to the upper and lower directions is transmitted to the valve member 32*b* via the valve member driving shaft and moves the valve member 32*b* close to or away from the valve seat of the orifice 32*a.* As a result, the refrigerant flow rate is controlled.

That is, the gas phase refrigerant temperature of the exit side of the evaporator 8 is transmitted to the upper pressure activate chamber 36*b*, and according to said temperature, the pressure inside the upper pressure activate chamber 36*b* changes, and the exit temperature of the evaporator 8 rises. When the heat load of the evaporator rises, the pressure inside the upper pressure activate chamber 36*b* rises, and accordingly. the heat sensing shaft 36*f* or valve member driving shaft is moved to the downward direction and pushes down the valve means 32*b* via the activating shaft 37, resulting in a wider opening of the orifice 32*a*. This increases the supply rate of the refrigerant to the evaporator, and lowers the temperature of the evaporator 8. In reverse, when the exit temperature of the evaporator 8 decreases and the heat load of the evaporator decreases, the valve means 32*b* is driven in the opposite direction, resulting in a smaller opening of the orifice 32*a*. The supply rate of the refrigerant to the evaporator decreases, and the temperature of the evaporator 8 rises.

In a refrigeration system using such an expansion valve, a so-called hunting phenomenon occurs wherein over supply and under supply of the refrigerant to the evaporator repeats in a short term. This happens when the expansion valve is influenced by the environment temperature, and, for example, the non-evaporated liquid refrigerant is adhered in the heat sensing shaft of the expansion valve. This is sensed as a temperature change, and the change of heat load of the evaporator occurs, resulting to an oversensitive valve movement.

When such hunting phenomenon occurs, it not only decreases the ability of the refrigeration system as a whole, but also affects the compressor by the return of liquid to said compressor.

The object of the present invention is to provide a cost effective expansion valve that avoids the occurrence of the hunting phenomenon in the refrigeration system with only a simple change in structure.

SUMMARY OF THE INVENTION

In order to solve the problem, the expansion valve of the present invention comprises a valve body having a first path leading to an evaporator for the liquid refrigerant to pass, and a second path for the gas refrigerant to pass from the evaporator to the compressor, an orifice mounted in the passage of said liquid refrigerant, a valve means for controlling the amount of refrigerant passing through said orifice, a power element portion mounted on the valve body having a diaphragm being displaced by sensing the temperature of said gas-phase refrigerant, and a heat sensing shaft for driving said valve means by the displacement of said diaphragm, wherein said heat sensing shaft includes a fitting means for fitting onto the heat sensing shaft a member for delaying the transmission of the change in said temperature to said power element portion.

Further, the expansion valve of the present invention characterized in that the heat sensing shaft comprises, on its periphery a sealing member for preventing connection between said first path and said second path, and further comprises a preventing member contacting said sealing member for preventing the movement of said sealing member.

In one embodiment, the present invention is characterized in that said preventing member is a self-locking nut.

In another embodiment, the present invention is characterized in that said self-locking nut is a push nut.

In a further embodiment, the present invention is characterized in that said preventing member is a snap ring with inner teeth.

In another embodiment the expansion valve of the present invention is characterized in that said heat sensing shaft comprises a stopper portion whose one end surface contacts said diaphragm, a large radius portion whose one end surface contacts the other end surface of the stopper portion not contacting said diaphragm, and a rod portion having a small radius and having one end fitting the other end surface of said large radius portion and the other end contacting said valve means, wherein said fitting means is formed on said other end surface of said large radius portion, and the rod portion of said heat sensing shaft comprises a sealing member positioned between said first path and said second path for preventing the connection between said two paths, and further having a preventing member placed so as to contact said sealing member for preventing the movement of said sealing member.

Further, the one end of said rod portion fits onto the other end surface of said large radius portion inside a projection member formed on the center portion thereof, and said fitting means being a concave portion mounted on the outer peripheral of said projection member, and said preventing member being a self-locking nut.

Still further, the expansion valve is characterized in that said self-locking nut is a push nut or a snap ring with inner teeth.

The expansion valve of the present invention having the above characteristics can prevent effectively the occurrence of the hunting phenomenon. When sensitive opening and closing reactions of the valve happens at the time of change in temperature of the refrigerant, the pre-equipped fitting means for fitting onto the heat sensing shaft a member for delaying the transmission of the change in the refrigerant temperature to the power element portion works effectively. When a resin having a low heat transmission rate is utilized as the member, the resin could be fitted to the heat sensing shaft, and delays the transmission of the change in temperature of the refrigerant to the power element portion, thus preventing sensitive opening and closing reaction of the valve even at a temporary heat change of the refrigerant moving toward the compressor from the evaporator. Moreover, by use of the expansion valve of the present invention comprising said fitting means, it could not only control the flow rate of the refrigerant flowing toward the evaporator as other conventional valves, but also drive the valve mechanism of the expansion valve by an operation of the power element portion sensing the heat change of the refrigerant flowing from the evaporator toward the compressor. Therefore, the expansion valve of the present invention can operate as an expansion valve without the use of the resin member on the fitting means depending on the degree of the hunting phenomenon.

Further, according to the present invention, the heat sensing shaft of the expansion valve itself could be pre-equipped with said fitting means, and the valve body could be formed to have the same structure as the prior art expansion valve, so utilization of a conventional valve body is possible. To further prevent the formation of connection of the two paths along the heat sensing shaft formed inside the valve body, in the present invention, a preventing member for preventing the movement of the sealing member positioned between said two paths utilizes a self-locking nut, for example, a push nut or a snap ring with inner teeth.

DETAILED DESCRIPTION

The embodiment of the present invention according to the drawings will be explained below.

Figure 1:
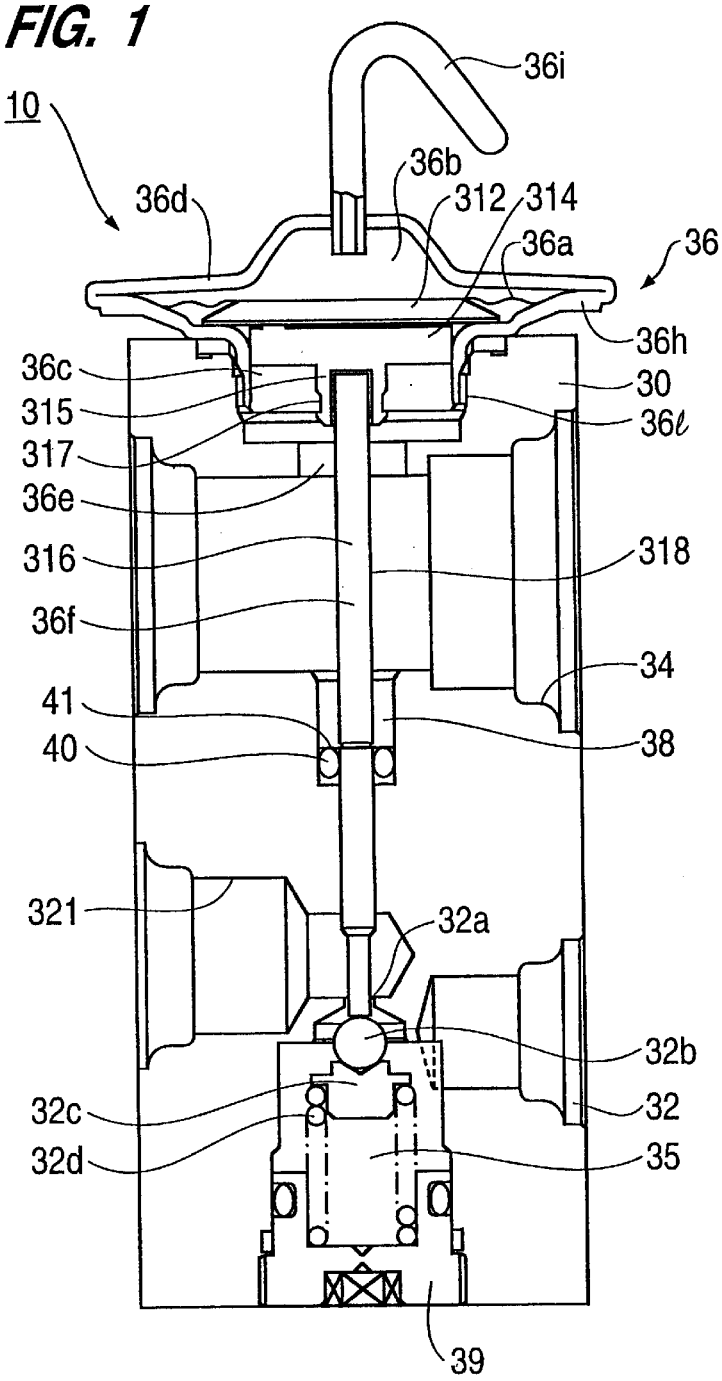
FIG. 1 is a vertical cross-sectional view showing one embodiment of the expansion valve of the present invention.
Figure 5:
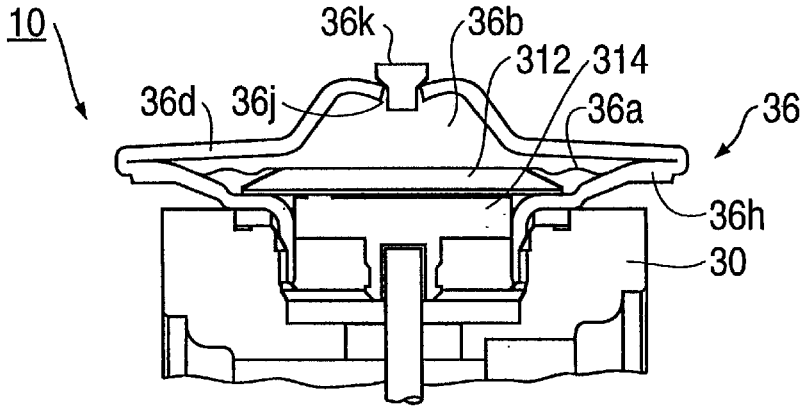
FIG. 5 is a drawing showing another embodiment of the power element regarding the expansion valve of the present invention.
Figure 6:
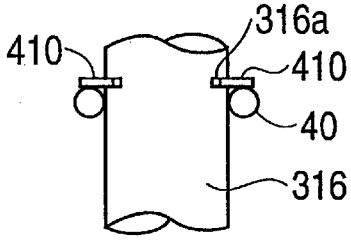
FIG. 6 is an explanatory view showing the snap ring with inner teeth used in another embodiment of the present invention.

FIG. 1 is a vertical cross-sectional view of the expansion valve 10 showing the refrigeration cycle, and the same reference numbers as FIG. 6 show the same or equivalent portions, but the structure of the heat sensing portion 318 differs from that of the expansion valve shown in FIG. 6. Further, the predetermined refrigerant can be sealed by using a plug body 36*k* as in FIG. 5 instead of the tube 36*i* of FIG. 1, and a plug body 36*k* made of stainless steel and the like is inserted to a hole 36*j* formed on the upper cover 36*d* made of stainless steel and welded thereto. In FIG. 5, the units related to the power element portion 36 are illustrated, and the other structures are omitted.

In FIG. 1, a heat sensing portion 318 is comprised of a large radius stopper portion 312 for receiving a diaphragm 36*a* having a heat sensing shaft 36*f* and a diaphragm 36*a* contacting its surface, a large radius portion 314 contacting the back surface of a stopper portion 312 at one end and the center portion of the other end formed inside a projection 315 and movably inserted in a lower pressure activate chamber 36*c,* and a rod portion 316 having one end surface fit the inside of the projection 315 of said large radius portion 314 and the other end surface attached and connected to the valve means 32*b* as one structure, wherein a concave portion 317 is formed on the outer periphery of the projection 315, and said concave portion 317 works as a fitting means for fitting a resin having low heat transmission rate for restraining the hunting phenomenon.

In the embodiment of the present invention, the valve body 30 utilizes a prior art valve body of an expansion valve, and the rod portion 316 forming the heat sensing shaft 36*f* is driven back and forth across a path 34 according to the displacement of the diaphragm 36*a* of the power element portion 36. Therefore, a clearance is formed along the rod portion 316 connecting the path 321 and the path 34. To prevent such connection, an o-ring 40 contacting the outer periphery of the rod portion 316 is positioned inside a large hole 38 positioned between the two paths. Further, to prevent the movement of the o-ring 40 by the force from a coil spring 32*d* and the refrigerant pressure inside the path 321 toward the longitudinal direction (toward the power element portion 36), a push nut 41 working as a self-locking nut is fixed to the rod portion 316 inside the large hole 38 contacting the o-ring 40. As for the rod portion 316, it is formed to have a smaller cross sectional area, or smaller radius compared to those on prior art expansion valves (for example, 2.44 mm compared to 5.6 mm in prior art expansion valves) in order to have a smaller heat transmission area, for preventing the hunting phenomenon. Therefore, by forming the valve body 30 in a prior art method, a connection of the two paths is likely to occur. In order to prevent such a connection, the push nut 41 for securely preventing the movement of the o-ring is provided.

Figure 2:
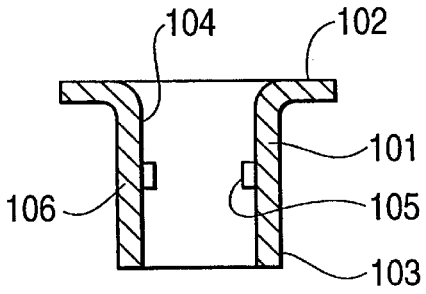
FIG. 2 is a cross-sectional view of the resin member explaining the embodiment of FIG. 1.

FIG. 2 is a cross sectional view showing one example of a member having low heat transmission rate to be fit to a concave portion 317 equipped on the expansion valve 10 of FIG. 1 for preventing the occurrence of the hunting phenomenon. In FIG. 2, the resin member 101 is formed by a resin material having a low heat transmission rate, for example, a polyacetals, to have a cylindrical shape with a flange 102. A connecting portion 105 protruding inwardly (having a height around 0.2 mm) is formed on an inner periphery 104 of a cylindrical portion 106 formed between the flange 102 and an end portion 103 on the other side. The resin member 101 is fitted to the outer periphery of the projection 315 formed on the large radius portion 314 of the heat sensing portion 318 of FIG. 1, and by fitting the connecting portion 105 to the concave portion 317 (for example, a groove formed to have a depth about 0.2 mm) formed on its outer peripheral surface, the resin member 101 is fit thereto by the elasticity of the resin member to keep a space between the projection 315 formed on the large radius portion 314 of the heat sensing portion 318.

Figure 3:
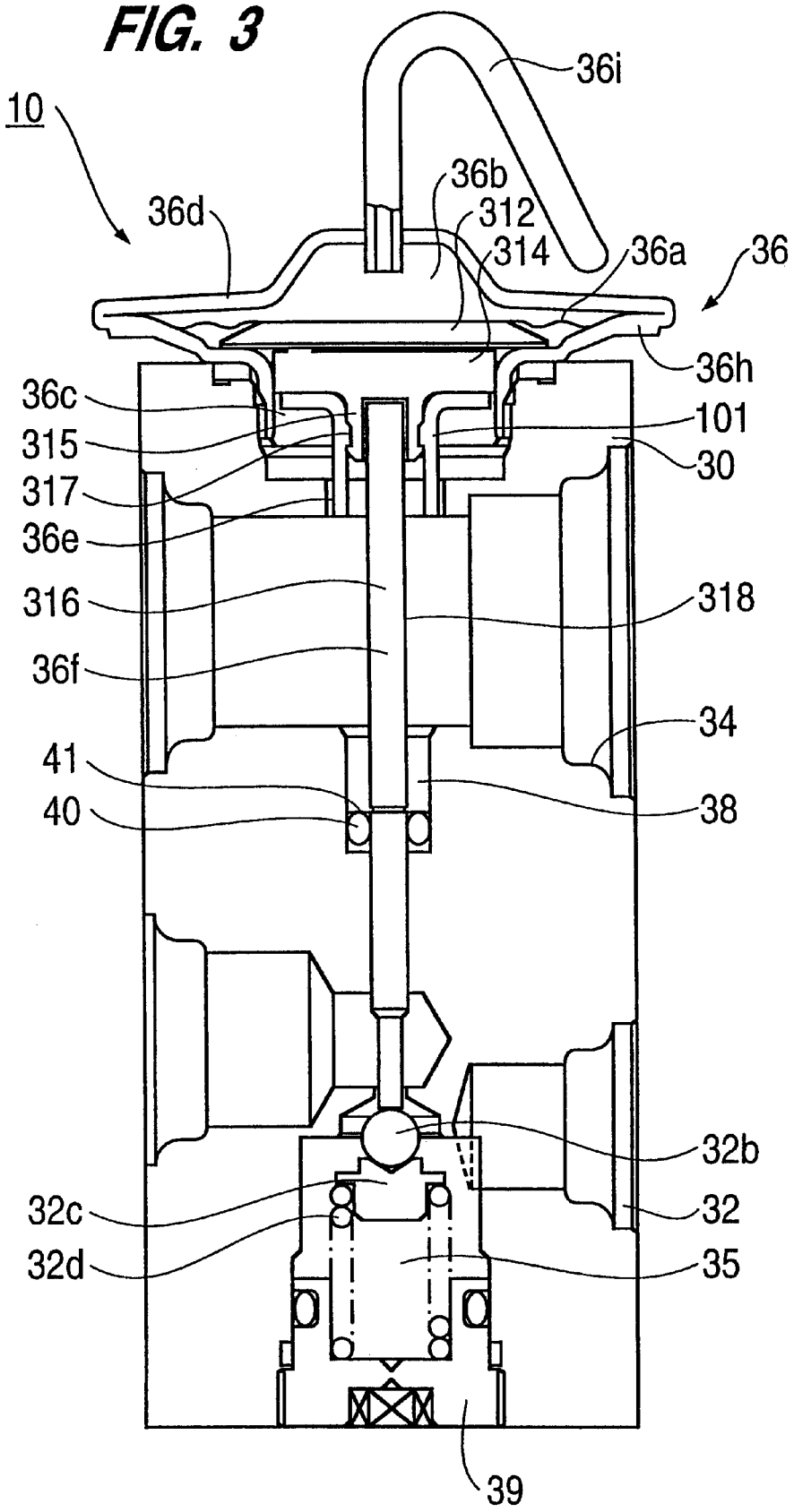
FIG. 3 is a vertical cross-sectional view explaining the state where the resin member is fit to the expansion valve of FIG. 1.

FIG. 3 is a vertical cross-sectional view showing the state where the resin member 101 is fit to the expansion valve 10 of FIG. 1. The resin member 101 is the only difference between the embodiment of FIG. 1.

As is shown, the expansion valve of the present embodiment is equipped with a fitting means for fitting a resin member having low heat transmission rate so as to prevent the sensitive opening and closing reaction of the valve structure. Therefore, when hunting phenomenon occurs, the resin member can be applied to prevent it.

Figure 4:
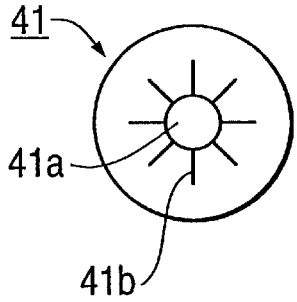
FIG. 4 is an explanatory view of the push nut of the embodiment of FIG. 1.

FIG. 4 is a plan view showing the push nut or self-locking nut shown in the embodiment of FIG. 1. The push nut 41 is, for example, a saucer-shaped disk made of stainless steel, comprising a center hole 41 a through which the rod portion 316 passes, and a cut-in 41*b* formed radially from the center hole 41. When the rod portion 316 is inserted to the center hole 41*a,* the metal portion between each cut-in 41*b* is lifted, pressed against and fixed to the rod portion 316 at a position contacting the o-ring 40, to prevent the movement of the o-ring. Of course, a snap ring with inner teeth could be used as the self-locking nut.

FIG. 6 shows another embodiment of the preventing member for preventing the movement of the o-ring 40. In this embodiment, a groove 316*a* is formed on the rod portion 316, and a snap ring with inner teeth 410 is fit into the groove 316*a*.

Figure 7:
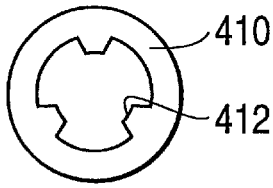
FIG. 7 is an explanatory view showing the snap ring with inner teeth.

FIG. 7 shows a plan view of the snap ring 410 with inner teeth, and the snap ring 410 with inner teeth has three teeth 412 formed inwardly for fitting into the groove 316*a* of the rod portion 316.

Figure 8:
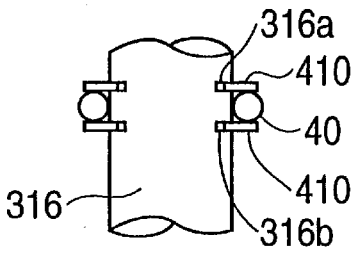
FIG. 8 is an explanatory view showing yet another embodiment of the present invention.
Figure 9:
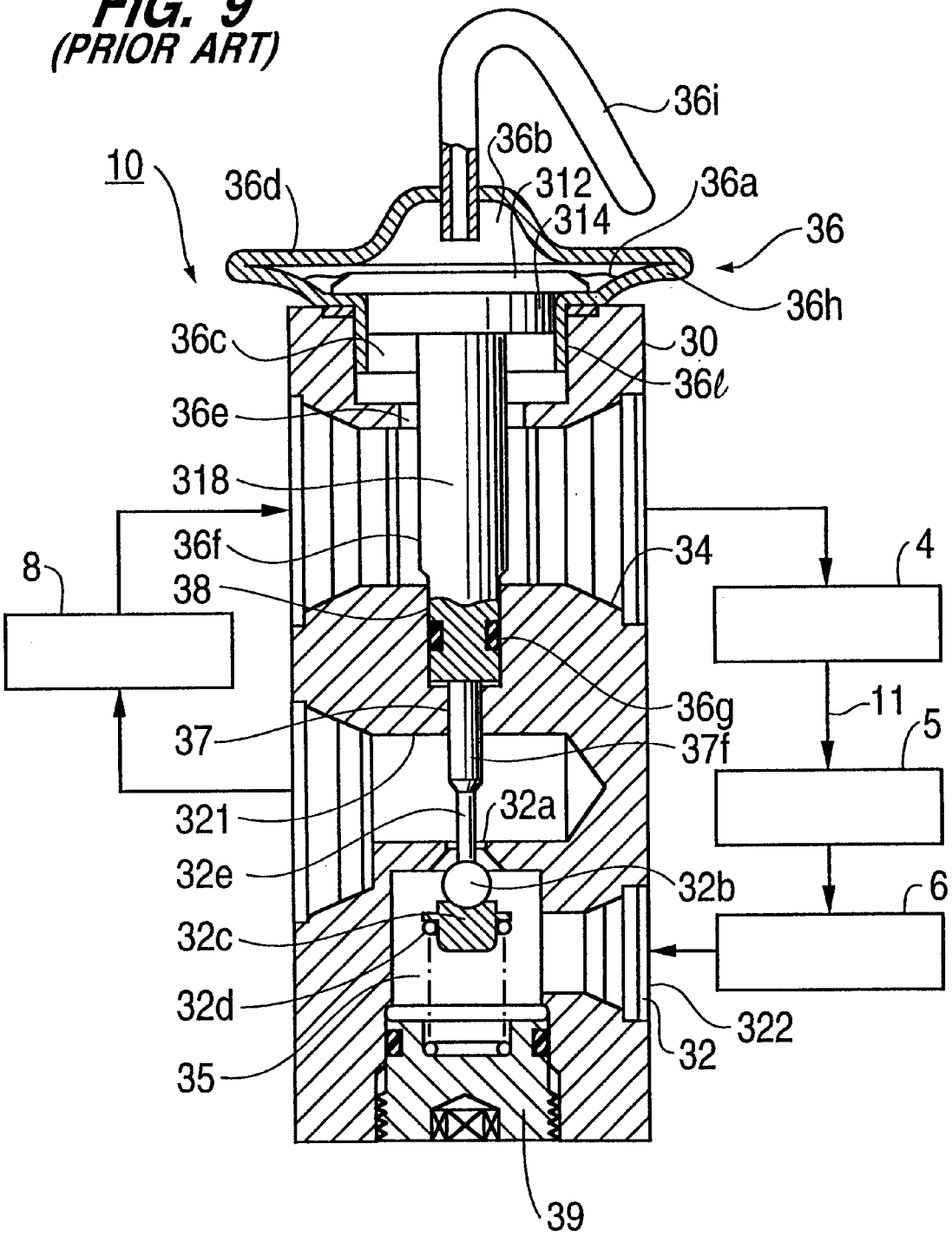
FIG. 9 (PRIOR ART)
FIG. 9 is a vertical cross-sectional view showing the expansion valve of the prior art.

FIG. 8 shows yet another embodiment. In this embodiment, two grooves 316*a* and 316*b* are formed on the rod portion 316, and two snap rings 410 with inner teeth are fit into the grooves.

The o-ring 40 is positioned between the two snap rings, and effectively prevents of any movement.

Further, the rod portion 316 inserted through the push nut 41 is fit inside the projection 315 of the large radius portion 314, so the metallic material of the rod portion 316 could be selected variously according to the degree of the hunting phenomenon. In the embodiment, a brass material is used as the stopper portion 312 and the large radius portion 314, and aluminum material is used for the rod portion 316. Further, a stainless steel material can be used as the rod portion 316. Even further, the stopper portion, the large radius portion and the rod portion can all be formed of stainless steel. Stainless steel material has a lower heat transmission rate than aluminum material, so it is even more effective for preventing hunting phenomenon. It is further possible to select the thickness of the resin member having low heat transmission rate shown in FIG. 2.

By the expansion valve of the present invention which includes a structure for supplying a fitting means for fitting a member onto the heat sensing shaft to prevent the occurring of hunting phenomenon, so it is possible to provide an expansion valve fully prepared against hunting phenomenon without substantial change in structure. When hunting phenomenon occurs, an expansion valve fully corresponded to hunting phenomenon can be gained by fitting the member for preventing the hunting phenomenon onto the heat sensing shaft by said fitting means.

What is claimed is:

1. An expansion valve comprising:

a valve body having a first path adapted for passage of a liquid-phase refrigerant to an evaporator and a second path adapted for passage of a gas-phase refrigerant from the evaporator to a compressor;

an orifice mounted inside the first path;

a valve in the first path, the valve controlling the amount of refrigerant passing through the orifice;

a power element portion connected to the valve body and having a diaphragm displaceable in accordance with the temperature of the gas-phase refrigerant;

a large radius portion operably connected to the diaphragm;

a heat sensing shaft having an upper end abutting the large radius portion and having a lower end abutting the valve so that the valve is controlled by the diaphragm displacement, at least a portion of the heat sensing shaft being adapted to be exposed to the gas-phase refrigerant; and a low heat sensitive member connected to the large radius portion, wherein the low heat sensitive member is made of a material that slowly conducts heat.

2. An expansion valve according to claim 1, wherein the low heat sensitive member is made of a resin with a low coefficient of heat conductivity.

3. An expansion valve according to claim 2, wherein the resin is polyacetal.

4. An expansion valve comprising:

A valve body having a first path adapted for passage of a liquid-phase refrigerant to an evaporator and a second path adapted for passage of a gas-phase refrigerant from the evaporator to a compressor;

an orifice mounted inside the first path;

a valve in the first path, the valve controlling the amount of refrigerant passing through the orifice;

a power element portion connected to the valve body and having a diaphragm displaceable in accordance with the temperature of the gas-phase refrigerant;

a large radius portion operably connected to the diaphragm;

a heat sensing shaft having an upper end abutting the large radius portion and having a lower end abutting the valve so that the valve is controlled by the diaphragm displacement, at least a portion of the heat sensing shaft being adapted to be exposed to the gas-phase refrigerant; and a low heat sensitive member connected to the large radius portion;

wherein the low heat sensitive member is made of a material that slowly conducts heat;

wherein the low heat sensitive member comprises a cylindrical portion and a flange extending substantially radially outwardly at one end thereof, the flange abutting the large radius portion.

5. An expansion valve according to claim 4, further including a stopper portion having a first surface contacting the diaphragm and a second surface opposite the first surface, wherein the large radius portion has a first surface that contacts the second surface of the stopper portion.

6. An expansion valve according to claim 5, wherein the large radius portion has a second surface and a substantially cylindrical projection extending outwardly from the second surface thereof, the substantially cylindrical projection forming a hollow cavity, which receives the upper end of the heat sensing shaft, the flange abutting the second surface of the large radius portion.

7. An expansion valve according to claim 6, wherein the substantially cylindrical portion is inserted into the cylindrical portion of the low heat sensitive member.

8. An expansion valve according to claim 7, wherein the substantially cylindrical portion has a protrusion extending radially inwardly from an inner periphery thereof, and an outer periphery of the substantially cylindrical projection has a groove that receives the protrusion to secure the low heat sensitive member to the large radius portion.

9. An expansion valve comprising:

A valve body having a first path adapted for passage of a liquid-phase refrigerant to an evaporator and a second path adapted for passage of a gas-phase refrigerant from the evaporator to a compressor;

an orifice mounted inside the first path;

a valve in the first path, the valve controlling the amount of refrigerant passing through the orifice;

a power element portion connected to the valve body and having a diaphragm displaceable in accordance with the temperature of the gas-phase refrigerant;

a large radius portion operably connected to the diaphragm;

a heat sensing shaft having an upper end abutting the large radius portion and having a lower end abutting the valve so that the valve is controlled by the diaphragm displacement, at least a portion of the heat sensing shaft being adapted to be exposed to the gas-phase refrigerant; and a low heat sensitive member connected to the large radius portion;

wherein the low heat sensitive member is made of a material that slowly conducts heat;

wherein the valve body has an opening for passage of the heat sensing shaft, the opening extending between the first path and the second path, and further including a sealing ring mounted on the heat sensing shaft, the sealing ring preventing the refrigerant leaking through the opening, and a preventing member that prevents the sealing ring from being displaced.

10. An expansion valve according to claim 9, wherein the preventing member is a self-locking nut.

11. An expansion valve according to claim 10, wherein the self-locking nut is a push nut.

12. An expansion valve according to claim 9, wherein the preventing member is a first snap ring, the heat sensing shaft having a first groove for receiving the snap ring.

13. An expansion valve according to claim 12, wherein the first snap ring has a plurality of inner teeth engaging the groove.

14. An expansion valve according to claim 13, further including a second snap ring, the heat sensing shaft having a second groove spaced axially from the first groove, the first and second snap rings sandwiching the sealing ring to immobilize the sealing ring.

* * * * *